US006544082B1

(12) United States Patent
Finerty

(10) Patent No.: US 6,544,082 B1
(45) Date of Patent: Apr. 8, 2003

(54) MANATEE PROTECTION INSTALLATION ON A BOAT

(76) Inventor: Morgan Marie Finerty, 731 92nd Ave., Naples, FL (US) 34108

( * ) Notice: Subject to any disclaimer, the term of this patent is extended or adjusted under 35 U.S.C. 154(b) by 0 days.

(21) Appl. No.: 10/059,980

(22) Filed: Jan. 30, 2002

(51) Int. Cl.[7] ..... B63H 5/16
(52) U.S. Cl. ..... 440/71
(58) Field of Search ..... 440/53, 56, 65, 440/71, 72

(56) References Cited

U.S. PATENT DOCUMENTS 1,226,699 A * 5/1917 Saunders ..... 440/71
1,473,832 A * 11/1923 Park, Jr. ..... 440/65
2,007,512 A * 7/1935 Walthers ..... 440/71
2,054,374 A * 9/1936 Fuller ..... 440/71
2,135,907 A * 11/1938 Miller ..... 440/62

* cited by examiner

*Primary Examiner*—Stephen Avila
(74) *Attorney, Agent, or Firm*—Werner H. Schroeder

(57) ABSTRACT

The invention is directed to a protective rod system which is installed on the bottom of a boat by a hinge assembly which installation is about midway between the length of the boat. The protective rod system is designed to prevent manatees from being hit by the propeller of the boat to avoid injury. The protective rod system is so designed that when in a deployed system, the protection to the manatee is in place or a retracted system whereby the bottom of the boat is substantially clear of any obstruction so that the boat can navigate in shallow waters. The protective rod system extends below and beyond the rotation circle of the propeller when activated or deployed.

6 Claims, 4 Drawing Sheets

MANATEE PROTECTION INSTALLATION ON A BOAT

CROSS REFERENCE TO RELATED APPLICATION (none)

STATEMENT REGARDING FED SPONSORED R & D (none)

REFERENCE TO SEQUENCE LISTING, A TABLE (none)

BACKGROUND OF THE INVENTION

The invention relates to a protection device for manatees. Manatees, also known as "sea cows" are most dominant in all of South Florida. More dominant in SW Florida and south Florida and somewhat less in SE Florida.

It is well known that Manatees are a slow moving, gentle and non-agressive animal of the sea that are almost on the endangered species list because of their activities under water. Manatees are not deep water animals but remain mainly at he upper region of any water level. That is, almost at the surface of the water chosen by them. This is so, because the manatees prefer warm water and warm water can almost always be found just at sea level. This is also so, because in cold winter climates, the manatees tend to congregate at inlets where warm water is discharged from power companies into an a channel or estuaries of the bays of SW Florida It is well known fact that many manatees are injured by boats driven by propellers at slow speed or at high speed. The reason is that manatees are very sluggish in the water and by the time they are aware that a boat (slow or fast) is approaching, they may not have the time to maneuver away so as not to get hit. Getting hit by the bottom the approaching boat normally does not induce much damage, but the high or low speed propeller does most of the damage because the propeller cuts into the outer skin of the manatee causing a substantial amount of damage.

Various restrictions as to speed of the boat and propeller speeds have been placed on the boating public. Such restrictions include speeds of the boat and the propeller. Such speeds are defined at which water craft proceeds fully off plane and is fully settled in their water with no wake created at all. The Coast Guard as well as the U.S. Wildlife Service are concerned with enforcing the above described restrictions and observances in the U.S water ways.

Nevertheless, the boating public Is either unaware, ignorant or deliberately disobeying the above noted restrictions when operating a boat in manatee occupied areas of the waterways and many injuries occur.

BRIEF SUMMARY OF THE INVENTION

Many devices have been installed on boats that are operating in manatee occupied areas of waterways or channels of water to avoid injuring the manatees. One such device is to enclose the propeller completely by a circular shroud that encircles the propeller. This type of device will never result in the propeller blades cutting into the outer skin of a manatee. However, this type of device will negatively impact on the performance of the propeller, because the shroud surrounding the propeller will disturb the water dynamics of the propeller to thereby inhibit its performance.

Another device has been introduced that will push the manatee away from the boat and thereby its propeller. This device consists of a shield that is mounted at about the middle of the bottom of the boat and thereafter flares outwardly to the vicinity of the propeller to thereby push away any manatee that might come into contact with the propeller of the boat and injure the manatee. However, while effective, this installation will not interfere with circumstances when the boat is in shallow waters without a danger of manatees present, the bottom of the boat might ground out on the bottom of the depth of the water.

DETAILED DESCRIPTION OF THE INVENTION

Figure 1:
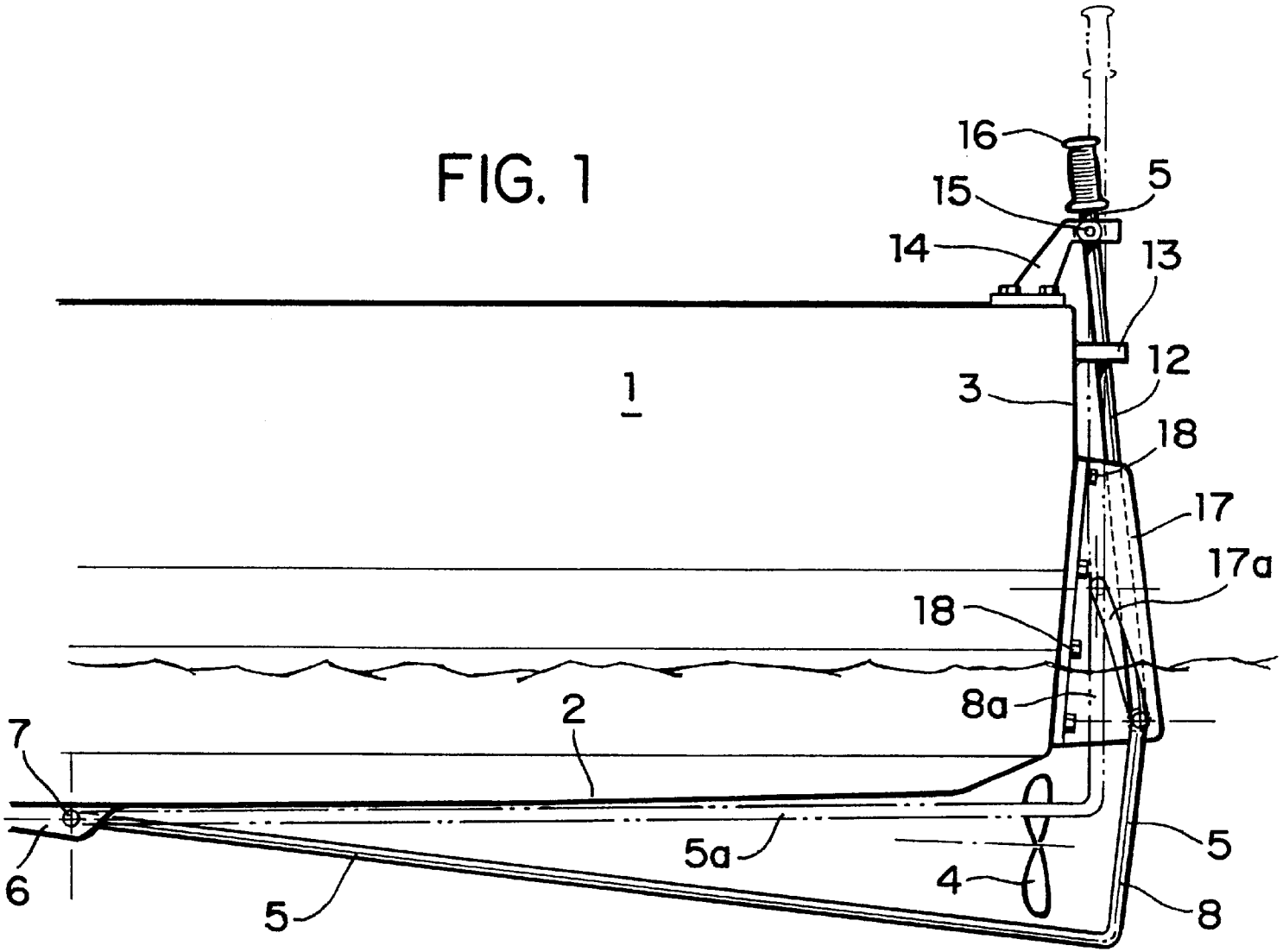
FIG. 1 is a side view of a boat with an inboard motor with the protection device installed.
Figure 2:
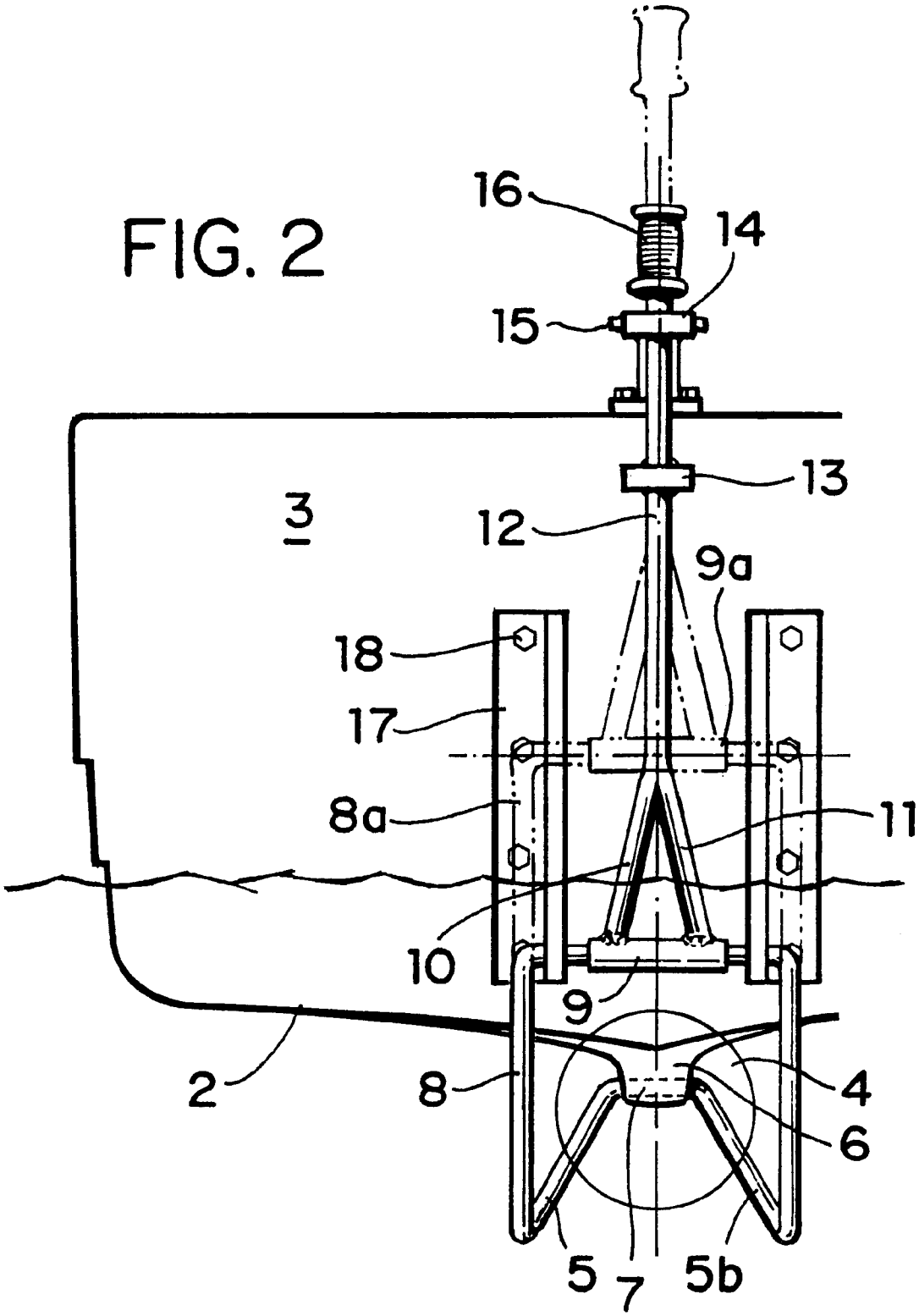
FIGS. 2 a rear view of the boat of FIG. 1.

FIG. 1 shows the inventive installation on a boat in a side view wherein the boat is shown at 1 and the bottom of the boat is shown at 2. The boat illustrated represents a boat that has an inboard motor. The end of the boat or the transom is shown at 3. The boat propeller is shown at 4. In FIGS. 1 and 2 there is illustrated the protective rod system which in FIG. 1 as shown as being deployed at 5, that is, the rod system is below the propeller 4. At 5*a*, the rod system is shown in a retracted position whereby the boat bottom is clear of any obstruction and can navigate in shallow waters or to stay clear of any underwater vegetation. To accomplish the deployed and the retracted positions, the protective rod system consists of two rods 5 and 5*b* as can be seen in FIG. 2. The two rods 5 and 5*b* converge toward each other at about the middle of the bottom of the boat, although any other position can be chosen. At the point where the two rods of the protective rod system converge, they are hinged at this point at a hinge 6 mounted on a hinge plate 7 as can clearly be seen in FIG. 2. To operate the two protective rods 5 and 5*b*, both bars are bent upwardly at about 90° in a location behind the propeller 4 as can clearly be seen in FIG. 1. The upwardly bent portion is shown at 8 in FIG. 1. The upper end of the upwardly bent portion 8 is bent is bent again at a substantially right angle in a horizontal plane as is clearly shown in FIG. 1. Of course the second rod 5*b* on the other side of the propeller 4 is bent in the same fashion and both ends of the horizontally bent portions meet in an operating tube 9. That is, if the operating tube 9 is moved up or down, the two bars 5 and 5*a* have to follow this movement and both protective bars move up or down from a deployed position to a retracted position. The upper ends 8 of the bent portions 8 obviously must undergo a curved motion because they hinged at a stationary point such as in hinge 7. To accommodate this curved movement, two guide plates 17 (only one is shown in both FIGS., 1 and 2) are mounted on the outside of the transom 3 with one on each side of the propeller. The guide plates 17 are mounted on the outside of the transom 3 by way of screws 18. The curved slot 17*a* in the guide plate 17 is so designed that it follows the same curved natural movement that the protective rod system undergoes when the rod system is moving up or down. The operating tube 9 is further connected to two upwardly and converging rods 10 and 11 which are then connected to a further upwardly extending control rod 12. The control rod 12 is guided in a guiding eye 13 and further in a bracket or adjusting plate 14. The adjusting plate 14 has a provision to have an arresting pin 15 pass there through and through the upper control rod. This way, the control rod and the entire protective rod system can be arrested in a deployed position or in a retracted position. For ease of operation the handle 16 has been attached at the upper end of the control rod 12.

Figure 3:
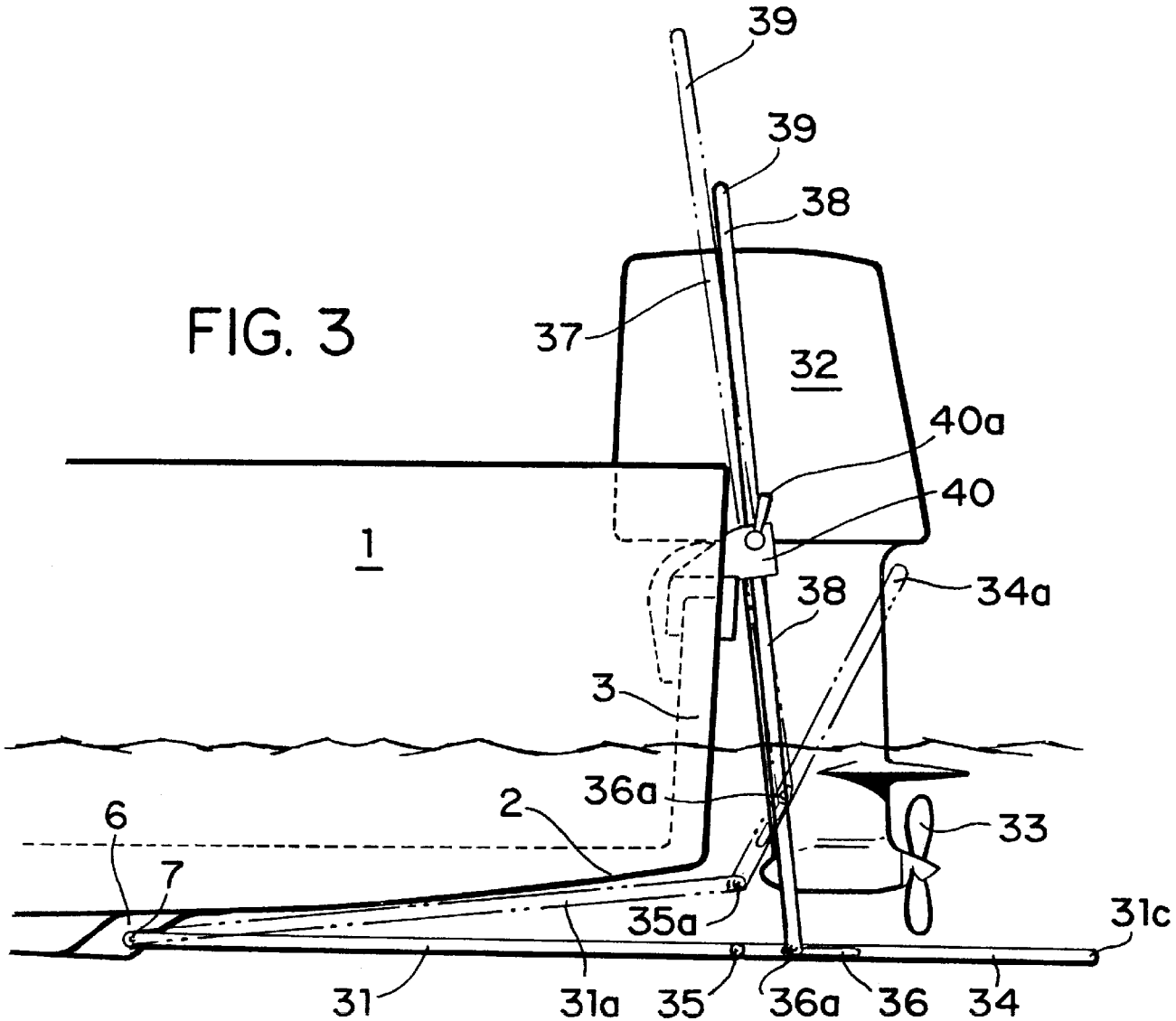
FIG. 3 is a side view of a boat having an outboard motor with the protection device installed.
Figure 4:
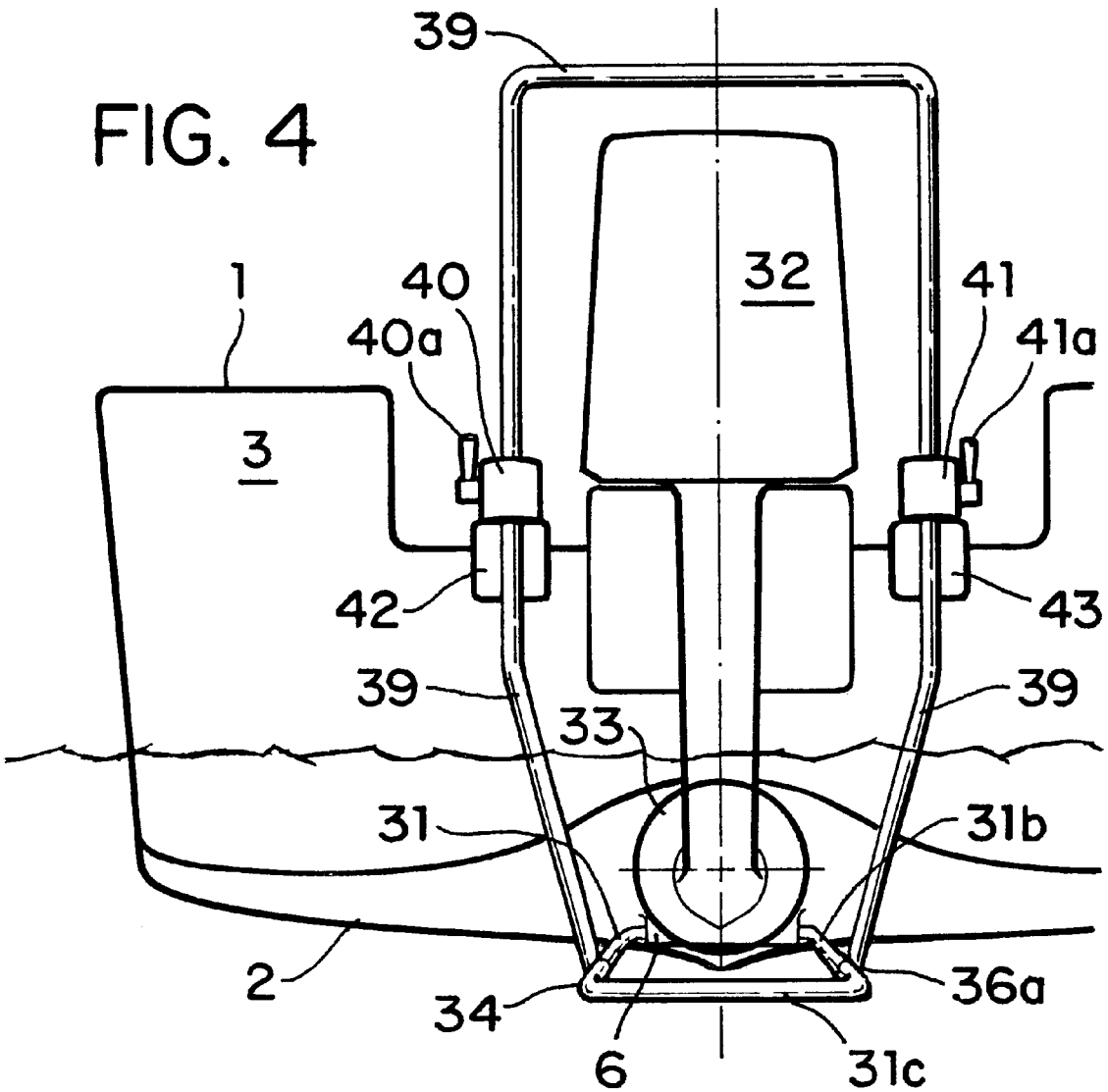
FIG. 4 rear view of the boat of FIG. 3.

Turning now to FIGS. 3 and 4 wherein Fig. is a side view of a boat 1 being powered by an outboard motor 32 which is clamped to the transom 3. as in FIG. 1, the bottom of the boat 1, these FIGS. 2 and 3 show the bottom of the boat at 2 and the transom at 3. The protective rod system is different from that shown in previous Figs. because is has to accommodate the swinging outboard motor 32. To this end, there are two protective bars 31*a* and 31*b*. As in the above embodiment, both bars converge toward each in the middle of the bottom of the boat 1 and are connected there to a hinge 7 the hinge plate 6. In FIG. 3, 31 indicates the deployed position of the protective rod system and 31*a* indicates the retracted position. At the ends of the rods 31 and 31*b* there is articulated a bow type rod at 36*a* which is wide enough to encompass the circle of the propeller 33. The bow type rod has two parallel side rods 34 and a connecting rod 31*c* which makes up the bow. When in an employed position, the bow type rod is an extension of the two hinged rods 31 and 31*b*. However, when in a retracted position, the bow type rod with its bow 31*c* hugs the outboard motor 32 as can clearly be seen in FIG. 3. In order to operate this particular protective rod system, two activating bars 37 and 38 (one on each side of the motor) are articulated to each of the rods 31 and 31*b* by way of sliding hinges 36*a* which slide in an elongated slot 36 in each of the rods 31 and 31*b*. included in each of sliding hinges or attached thereto are two upwardly extending (left and right) activating rods 37 and 38. The upper ends of the activating rods 37 and 38 are connected to each other by a rod 39 which again makes a bow type connection which acts as bow type handle. Both activating rods 37 and 38 slide through left and right guide bushings which are fastened to the transom 3 on both sides of the motor. Each of the guide bushings 42 and 43 have clamping handles attached thereto so that the activating rods sliding there through can be arrested in any position. The preferred positions are a deployed position for the protective rod system or a fully retracted position when the system is not in use. For stability both activating rods 37 and 38 can be connected to each by a cross rod 39 at their tops.

This protective rod system operates as follows:

In a deployed position, the cross bar 39 is pushed down after both clamping handles have been loosened. The lower connecting hinges 36*a* on both sides of the activating bars 37 and 38 will be riding in the slots 36 to a far position as possible. This will ensure that the hinged extension 34 will be kept at a rigid horizontal position even if hit by a manatee. Also at the same time the protective rods 31 and 31*b* will be in down position. This position of all of the rods keeps the propeller out of reach of an impact. In order to deactivate the protective rod system, it is a mere operation to loosen both clamping handles 40*a* and 41*a*, to pull first back on cross bar 39 whereby the sliding hinge 36*a* slides forward in slot 36. An upward pull of the upward cross bar will lift the hinged extension upwardly an bring in an upwardly slanted position as is shown in FIG. 3 and at the same time the two protective rods 31 and 31*b* are being lifted too and are thereafter in a substantially flat position against the bottom of the boat. Thereby the bottom of the boat and the circle of the propeller are substantially unobstructed. A reengagement of the clamping handles will keep the protective rod system in a retracted position.

What I claim is:

1. A protective rod system adapted to be installed on a bottom of a boat to protect a manatee from being hit by a propeller of said boat, said protective rod system comprising at least two elongated rods being mounted on said bottom of said boat at about midway of the lengths of said boat, said mounted elongated rods are connected at a common point, said common point represents a hinge, said elongated rods have ends extending toward a rear of said boat and past a circle of a propeller on said boat, means for lowering said elongated rod rods to a protective position to a point below said circle of said propeller and means for raising said elongated rods to an inactive position whereby said elongated bars be substantially parallel and in contact with said bottom of said boat, means for arresting said elongated bars in either the protective position or the inactive position, wherein said two elongated rods with their ends extending past the circle of said propeller include upturned ends extending in a substantially vertical direction, wherein said two elongated at their upturned ends are again bent in a horizontal direction toward each other and the ends of these two rods are contained in a horizontal tubular sleeve.

2. The protective rod system of claim 1 including a vertical rod being connected to said two elongated rods and further being slidingly connected to a transom at a rear of said boat.

3. The protective rod system of claim 2, wherein said sliding connection includes said means for arresting.

4. The protective rod system of claim 1 including a vertical rod attached to said tubular sleeve extending upwardly into a guide eye and further extending upwardly into said means for arresting said vertical rod so that said protective rod system is in an active or retracted position.

5. The protective rod system of claim 1 including means for extending said at least two rods beyond said circle of said propeller, said extension being hinged to said at least two rods at a position which is at a position between a transom of said boat and said circle of said propeller, said hinged extension includes means for moving said hinged extension upwardly to a retracted position.

6. The protective rod system of claim 5 including means for arresting said at least two rods and said hinged extension in either an activated position or a retracted position.

* * * * *